United States Patent [19]

Hankin

[11] Patent Number: 4,506,884

[45] Date of Patent: Mar. 26, 1985

[54] BODY STRETCHER SYSTEM

[76] Inventor: Stuart M. Hankin, Apt. 1-J, 3018 Fallstaff Manor Ct., Baltimore, Md. 21209

[21] Appl. No.: 471,886

[22] Filed: Mar. 3, 1983

[51] Int. Cl.[3] ..... A63B 21/00

[52] U.S. Cl. ..... 272/127

[58] Field of Search ..... 272/70, 93, 144, 126, 272/127, 134, DIG. 5, 116, 109; 104/247

[56] References Cited

U.S. PATENT DOCUMENTS

| | | | |
|---|---|---|---|
| 368,515 | 8/1887 | Chadeayne | 104/247 |
| 1,982,843 | 12/1934 | Traver | 272/70 |
| 2,938,572 | 5/1960 | Solloway et al. | 272/144 X |
| 3,101,944 | 8/1963 | Cencig | 272/127 X |
| 3,374,782 | 3/1968 | Izzo . | |
| 3,524,644 | 8/1970 | Kane | 272/134 |
| 3,559,986 | 2/1971 | Ehrmantraut | 272/127 |
| 3,589,720 | 1/1971 | Againion . | |
| 3,659,844 | 5/1972 | Cummins | 272/109 X |
| 3,834,693 | 9/1974 | Poppenberger . | |

*Primary Examiner*—Richard J. Apley
*Assistant Examiner*—William R. Browne
*Attorney, Agent, or Firm*—John F. McClellan, Sr.

[57] ABSTRACT

A muscle stretching and exercising system provides in a first embodiment a hinged, folding base with folding legs; a detachable user-supporting handle structure. In the extended position the base provides on the top surface a pair of tracks on which two carts run. Each cart has a cushioned pivotal platform on it. A user grasping the handle structure may support one leg on each cart and stretch his or her muscles, particularly those associated with the legs, either by kneeling in whole or in part or by placing other portions of the legs on the carts. Stops and measuring indicia may be provided, as well as quick-release cart removal. A second, non-folding, embodiment may have modified handle structure and line and pulley structure for drawing carts together, either manually or electrically. The handle structure in each embodiment may be adjustable.

5 Claims, 13 Drawing Figures

BODY STRETCHER SYSTEM

FIELD OF THE INVENTION

This invention relates generally to athletic training apparatus and specifically to a system for stretching muscles of the human body.

BACKGROUND OF THE INVENTION

Various forms of apparatus have been disclosed which have the capacity for developing muscles of the human body, including those in the following U.S. Patents:

U.S. Pat. No. 3,374,782 to C. P. Izzo, 3-26-68, disclosed a pair of separate pivotal platforms for exercising with the feet on them:

U.S. Pat. No. 3,589,720 to A. Agamian, 1-29-71, disclosed a frame or track with independently movable platforms (and hand holds on one but not on the frame);

U.S. Pat. No. 3,834,693 to L. H. Poppenberger, 9-10-74, disclosed a complex of elements in an exerciser; from the top: two pivotal rests for the feet, mounted each on a separate wheeled carrier, then those on another wheeled carrier and finally a frame on a pivotal base assembly.

SUMMARY OF THE INVENTION

The purpose of the system is to enhance flexibility in the legs, especially the quadriceps and hamstrings, of athletes who participate in various endeavors. The inventor feels this to be particularly beneficial for martial artists, dancers, hurdlers, gymnasiasts, runners of all types, and persons rehabilitating from hips disabilities.

This system has several advantages over previous stretching apparati:

(1) The operator controls the degree of stretch;

(2) Gravity provides the force for the stretch;

(3) Resistance which would oppose the stretch is minimized by wheels in a track;

(4) Several different stretching exercises can be done with just one apparatus;

(5) The hip joint can move in its entire range while simultaneously stretching the legs;

(6) The legs can be isolated one at a time, and alternatively bilateral stretching is also provided for;

(7) Most of the exercises are done while on the knees, which eliminates stress against the knee joint which would occur with the legs in an extended position; also overstretching of the hamstring at insertion point in knee is minimized;

(8) Removable side handrails and adjustable front handrail provide support of the operator in such an alignment as to get the most from the stretch; additionally the supports provide for a sustained stretch;

(9) For martial artists and hurdlers in particular, the lateral stretching at the hip joint provides for proper body alignment (e.g. the same as if the operator were engaged in the actual athletic event);

(10) The pivotal (rotating) seats permit the operator to continue from one stretch to another without delay;

(11) The track provides a gradual and smooth stretch avoiding the ligament and tendon-tearing bounce of stretching so common with many systems.

(12) The apparatus is marked along its length to provide the user with a measure of his progress which can be charted from day-to-day.

This apparatus has two basic models, a stationary and a portable model. The stationary model allows for a more gradual stretch and a concommitant facilitation of recovery from the stretch position by means of pulley which can be attached to a crank or an electric motor. Additionally, an adjustable center handle is provided for additional support and versatility.

The portable model is designed to be light weight and compact with transport and storage is mind.

BRIEF DESCRIPTION OF THE DRAWINGS

The above and objects and advantages of this invention will become more readily apparent on examination of the following description, including the drawings in which like reference numerals refer to like parts.

DETAILED DESCRIPTION

Figure 1:
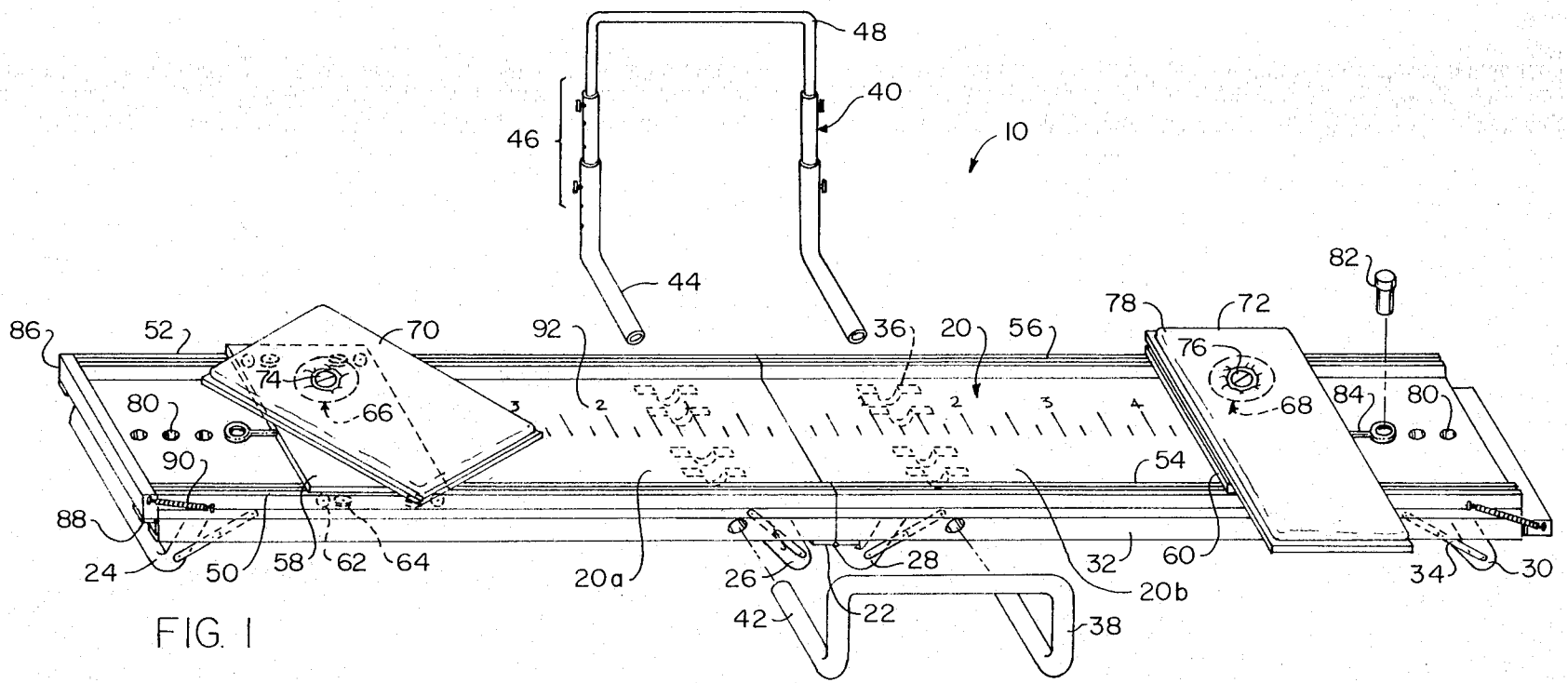
FIG. 1 is a perspective view of a first or portable embodiment of the invention.

FIG. 1 shows the portable embodiment 10 of the invention. Base 20 is rectangular and comprises two pieces, mirror-image rectangular halves 20*a*, 20*b* abutted end-to-end and held there by a hinge 22 fastened to the ends, transversely of the length of the base.

Four transverse pivotal supports or legs 24, 26, 28, 30, two on each base half, fold beneath the base halves within a recess formed by a frame 32 around the lower face of each base half. Card-table-leg type folding elbow braces 34 may be provided to maintain the legs in extended position at the extremities of the base halves.

Hinge 22 is mounted on the frames 32 to permit down-folding of the base halves for compact storage.

To mount the handles to be described at the mid-portion of the base, beneath each base half are a plurality of half-loops 36 mounted across the bottom, near the hinge. These half loops 36 are aligned in two parallel rows of preferably four each, and detachably mount an upright rear inverted-"U"-shaped handle 38 and an upright front inverted-"U"-shaped handle 40 by the respective twin laterally extending arms 42, 44 of each, which slide into two of the respective half loops from each side.

The front inverted "U"-shaped handle or "U"-handle 40 has a telescoping upright portion 46 on each side for height adjustment of the cross-bar portion 48.

Each base half 20*a*, 20*b* has bolted along each long margin spaced parallel tracks 50, 52, 54, 56. These paired tracks are formed of a square "C"-section channel with the slotted side up.

On each base half a cart 58, 60 rides or moves in the respective track by means of a supporting or horizontal-axle wheel 62 at each corner and which rolls on the base of the track and a guiding or vertical axle wheel 64 which guides on the upright portion of the track adjacent each supporting wheel 62. The wheel axles are affixed to the respective carts 58, 60.

Pivotally supported on each cart of the pair by a bearing 66, 68, is a pivotal platform 70, 72. Cart and pivotal platform may be the same width and held in coincidence at the front side by the bearing, but the pivotal platforms are half again as long as the carts, so that when aligned they overhang at the rear. The bearing of each cart/platform assembly is on the long centerline adjacent the front, and may have a screw 74, 76 for adjusting pivotal friction in the bearing by squeezing the bearing assembly together. The top of each pivotal platform preferably has a pad 78 affixed on it for user comfort in kneeling, with a hole in it for screw-access.

In the top of each base half 20*a*, 20*b* is a series of holes 80, spaced along the centerline. A headed pin 82 can be dropped into a selected one of these holes to limit adjustably the outward travel of the carts. Each cart may have extending from it an eye 84 for capture by a pin 82 thrust into a hole 80 as means for fixing a cart in a selected position.

Also limiting outward travel of each cart is a respective end gate 86 held by a hinge 88 on the outboard end of each base half across the ends of the tracks.

A spring 90 at the front and similarly one at the back retains each end gate detachably across the end; when desired, each assembly 58, 70, 60, 72, of cart and platform end may be removed by pivoting down the end gates 86 clear of the tracks.

Scale indicia 92 along the top of the base halves provide means for displaying cart displacement along the tracks.

Figure 2:
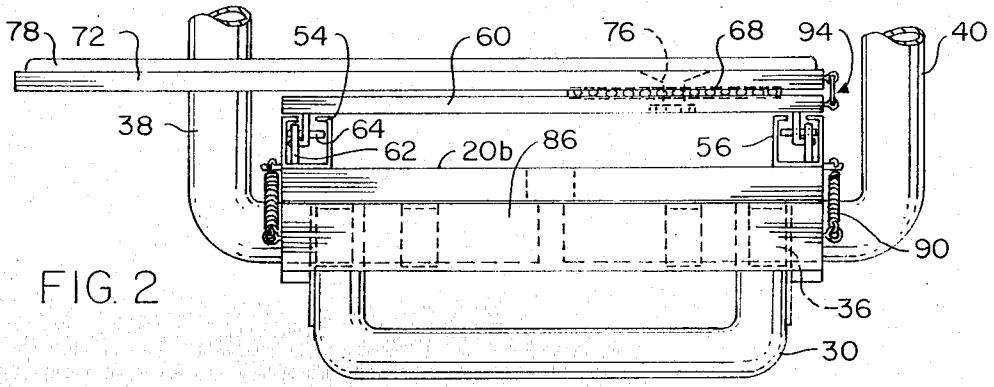
FIG. 2 is an end elevational detail thereof.

FIG. 2 is an end view assembly detail similar to that of the right end shown in the first Figure, showing positions of leg 30, front "U"-handle 40, rear "U"-handle 38, half loops 36, base half 20*b*, tracks 54, 56; wheels 62, 64 extending from the base into the tracks, which retain them, end gate 86 and springs 90, screw 76 for retaining and compressing conventional thrust bearing 68 by forcing pivotal platform 72 and cart 60 against it in conventional manner, integral pad 78 on the pivotal platform, and a latch assembly 94 for holding the rotational position of the pivotal platform relative to the cart 60.

Figure 3:
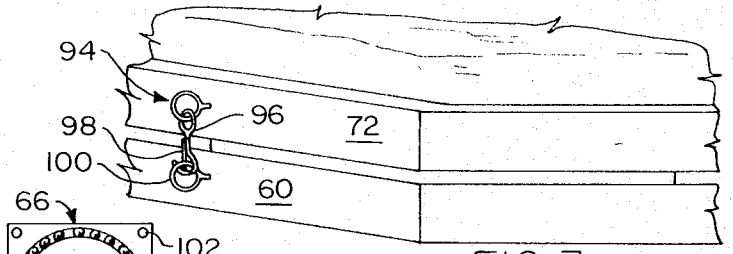
FIG. 3 is a perspective detail of a latch installation.

FIG. 3 shows that latch assembly 94 may comprise a conventional hook-and-eye 96 with a spring keep 98 on each pivotal platform and cart (72, 60 indicated) for engaging an eye 100 on each cart. The latch assembly may be on the end or on the side where it can hold the pivotal platform parallel with the base half for compact storage or transport.

Figure 4:
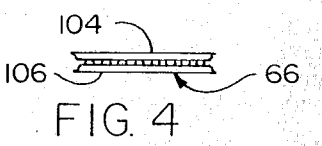
FIG. 4 is a side elevational view of a bearing.
Figure 5:
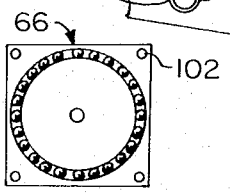
FIG. 5 is a plan view thereof.

FIGS. 4 and 5 are respectively an elevational detail of either bearing, 66 shown, and a plan detail of the bearing. It may be held on by screws through holes 102 in the outer edges of the race plates 104, 106 or by being recessed in the pivotal platform and cart and retained by the screw previously described. These may be any suitable typical commercial thrust bearings.

Figure 6:
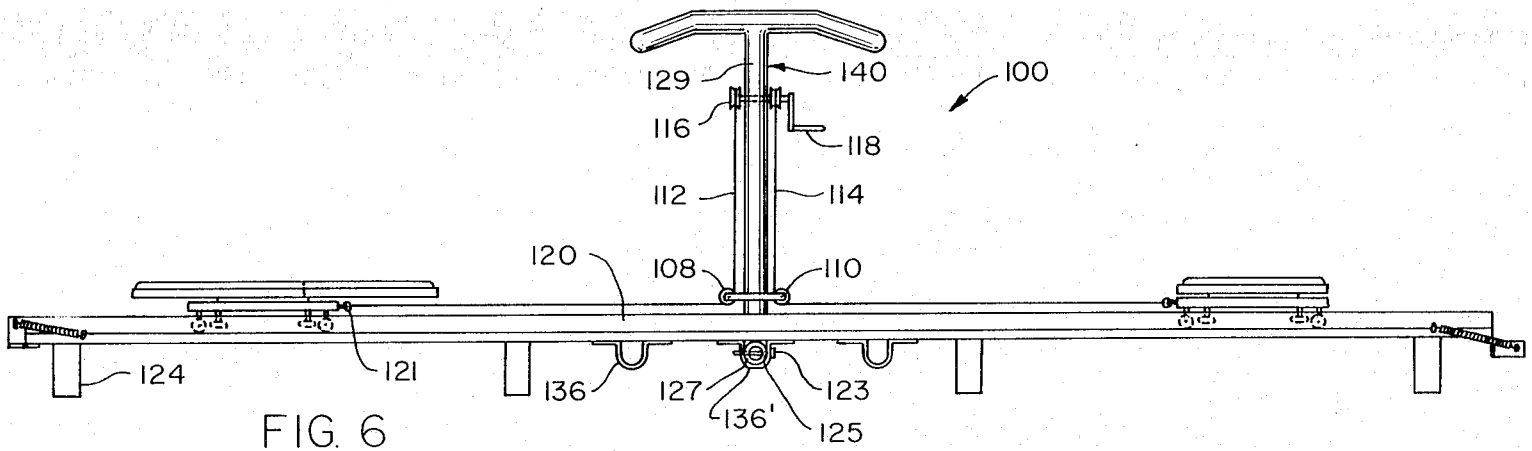
FIG. 6 is a side elevational view of a second or stationary embodiment of this invention.

FIG. 6 is a rear elevational view of the stationary embodiment 100 of this invention which is similar to the portable model except as follows. Base 120 is unitary. Legs 124 fixed at spaced intervals support it. Half loops 136 are as before, except that a third row of half loops 136' between the rows for the "U"-handles (not shown) supports the horizontal portion of a "T"-handle 140 rising centrally of the base on the front side with the crossbar parallel with the base. On the "T"-handle are clamped pulleys 108, 110 over each of which a line 112, 114 leads from a reel 116 with a crank 118 down to the pulley, and then out to an eye 121 in the near side of the cart. The user can wind the carts together, if desired, using the crank. A pin 123 can be passed through hole 125 in the horizontal portion 127 of the "T"-shaped handle under the table and through the half loops 136' holding it, to prevent rotation.

The shank 129 of the "T"-shaped handle may have an adjustment in-and-out from the base 120.

Figure 8:
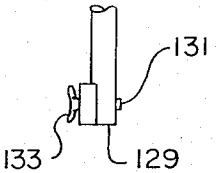
FIG. 8 is an end-elevational detail thereof.
Figure 7:
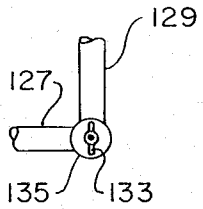
FIG. 7 is a side elevational detail of a handle adjustment variation.

FIGS. 7 and 8 show this "T"-shaped handle adjustment in a fragmentary detail.

A bolt 131 which may have a wingnut 133 on it passes through and clamps together the first circular perforate plate 135 fixed on the end of the horizontal portion 127 and a similar, second circular perforate portion which is on the lower end of the shank 129. Tightening the bolt fixes the angle of the joint and thus the position of the "T"-handle.

Figure 9:
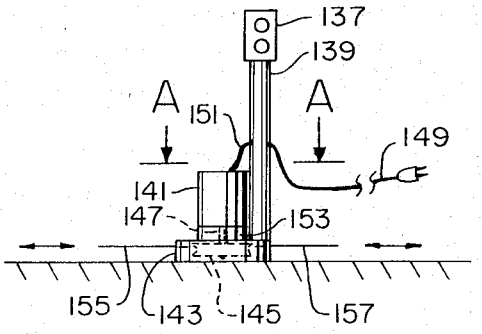
FIG. 9 is a side elevational view of an alternative handle and cart winding provision.
Figure 10:
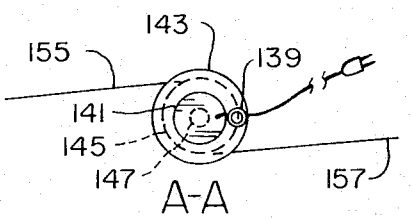
FIG. 10 is a plan view fragmentary detail thereof taken at A—A, FIG. 9.

FIGS. 9 and 10 show a further provision. Fixed on the base at the inboard side of the "T"-shaped handle is an on-off switch 137 on a pedestal 139 and adjacent to it a motor 141 with hollow-base circular mount 143 containing within it a pulley 145 on the driveshaft 147 of the motor. The switch controls current supplied through a line cord 149 and lead 151 to the motor.

The motor turns the pulley 145 through a gearbox 153 and winds in or lets out a line 155, 157 on either side to draw in or to slacken-off the carts. The lines are wound on the pulley in the same direction but lead from it in opposite directions.

The following Figures or exercising diagrams illustrate a few exercises and instructions for these exercises.

Figure 11:
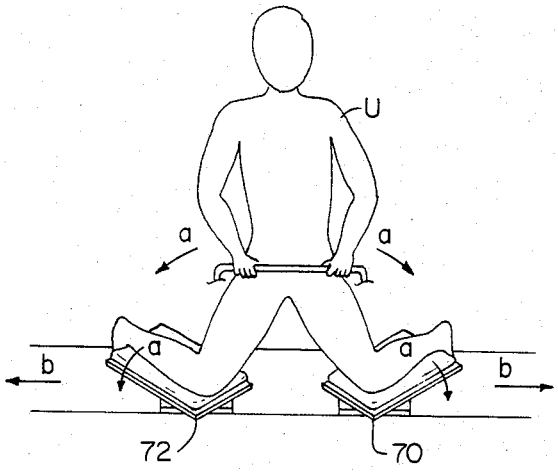
FIGS. 11, 12 and 13 are diagrams showing a few methods of use of the apparatus by a user.

FIG. 11 diagrams a user "U" following these directions:

—get on apparatus with knees facing front, back straight, and legs and buttocks aligned vertically.

—as at "A" allow feet to rotate away from each other on pivotal platforms 70, 72;

—as at "b" let pivotal platforms slide apart.

Figure 12:
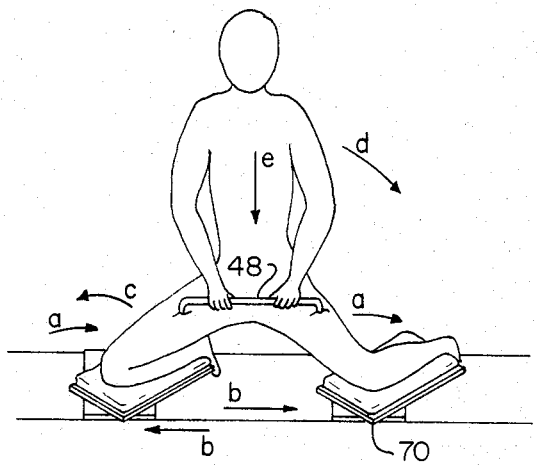

FIG. 12 diagrams directions as follows:

—as at "a", begin same way as in FIG. 11, except rotate on knees so that feet point in same direction, isolating the leg extended in that direction, as shown on platform 70.

—as at "b", let knee of extended leg slide out on pivotal platform 70 in above direction horizontally to stretch the groin muscles;

—variation: as at "c" and from the stretched position, rotate the non-extended leg gradually away from the other leg;

—variation: repeat as above; lean toward the side (side-bend) where the leg is extended; as described by motion "d";

—variation: repeat as above; lean forward over the front bar 48 as described by motion "e".

Figure 13:
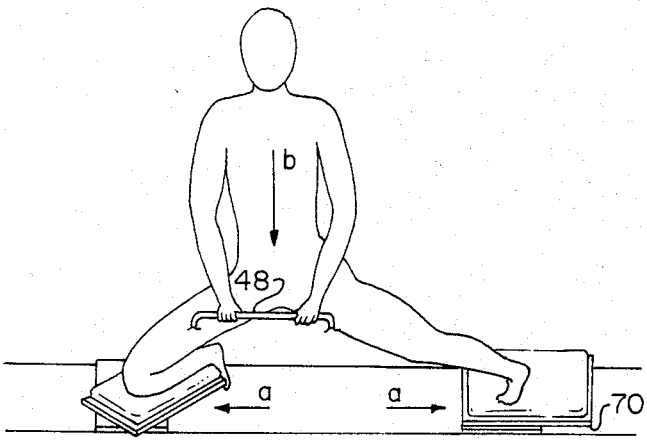

FIG. 13 diagrams directions as follows:

—as at "a" repeat previous exercise, except place one foot (heel) on one platform 70 with the other knee on the other platform;

—allow the cart with extended leg on the platform 70 to slide out horizontally to the side;

—use the above "variations" to develop the stretch in the position;

—repeat as above, and as at "b" lean forward over the front bar 48.

From the above it will be appreciated that each of the pivoted platforms is proportioned for receiving a nominal size knee and shin thereon, and that the carts are movable along the tracks from abutment with each other to a distance providing for extreme flexing of muscles associated with the legs.

Where the first and second parallel-spaced inverted "U"-shaped handles are grasped, one in either hand, placing a portion of a respective leg on each respective platform provides another muscle stretching or extension position for a nominal size human body.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States patent is:

1. A system for stretching muscles and tendons and ligaments of the human body, comprising a base, said base being rectangular with sides and ends, a pair of tracks along the base, a pair of carts, means movably engaging the carts with the tracks, each cart having a pivotal platform thereon, at least one handle laterally engageable with the base along a mid-portion of a side of the base, each of said pivotal platforms proportioned for receiving a nominal size human knee and shin thereon, said carts movable along said tracks a distance providing for extreme flexing of muscles associated with said nominal size human knee and shin, said at least one handle comprising a "T"-shaped member with a lateral extension portion along a lower part thereof, and means on the "T"-shaped member for drawing the carts together.

2. A system as recited in claim 1, said means for drawing the carts together including a crank.

3. A system as recited in claim 1, said means for drawing the carts together including a motor and a switch for controlling the motor.

4. A system as recited in claim 1, and a bolt-tightenable elbow joint for adjusting the "T"-shaped member relative to the lateral extension portion.

5. A system for stretching muscles and tendons and ligaments of the human body, comprising a base, said base being rectangular with sides and ends, a pair of tracks along the base, a pair of carts, means movably engaging the carts with the tracks, each cart having a pivotal platform thereon, at least two handles each being laterally engageable with the base along a mid-portion of a side of the base, each handle of said at least two handles comprising an inverted "U"-shaped member with a pair of laterally extending arms, one of said "U"-shaped members having telescoping structure for height adjustment, the other of said at least two handles being parallel-spaced from the first mentioned handle and on an opposite side of the base therefrom, the spacing between the said at least two handles providing for a normal size human to support himself by gripping each handle with a respective hand while placing one leg on each respective pivotal platform, means on the base for detachably holding said laterally extending arms thereto, said base comprising a first piece and a second piece abutted thereon, a hinge foldably joining said first and second pieces, a frame around each of said first piece and second piece as part of said base, the hinge being on the frame, and a plurality of base-supporting legs foldable within said frame.

* * * * *